US007543712B2

(12) United States Patent
Purushothaman

(10) Patent No.: US 7,543,712 B2
(45) Date of Patent: Jun. 9, 2009

(54) ARTICLE RETAINERS FOR A DISHWASHER RACK

(75) Inventor: Balaji Purushothaman, Kinston, NC (US)

(73) Assignee: Electrolux Home Products, Inc., Cleveland, OH (US)

( * ) Notice: Subject to any disclaimer, the term of this patent is extended or adjusted under 35 U.S.C. 154(b) by 627 days.

(21) Appl. No.: 11/087,005

(22) Filed: Mar. 22, 2005

(65) Prior Publication Data

US 2006/0213844 A1 Sep. 28, 2006

(51) Int. Cl.
*A47G 19/08* (2006.01)

(52) U.S. Cl. ..... 211/41.9; 211/41.8

(58) Field of Classification Search ..... 211/41.9, 211/41.8, 181.1, 183, 184, 74
See application file for complete search history.

(56) References Cited

U.S. PATENT DOCUMENTS

| | | | | |
|---|---|---|---|---|
| 2,677,468 | A | | 5/1954 | Dreyfus, Jr. |
| 2,708,037 | A | | 5/1955 | Planeta |
| 2,841,288 | A | | 7/1958 | Field et al. |
| 3,289,854 | A | | 12/1966 | Kauffman |
| 3,451,556 | A | | 6/1969 | Macoicz |
| 3,451,557 | A | | 6/1969 | Stoddard |
| 4,589,556 | A | | 5/1986 | Peretz |
| 4,917,248 | A | | 4/1990 | Friskney |
| 4,927,033 | A | | 5/1990 | Patera et al. |
| D314,256 | S | | 1/1991 | Patera et al. |
| 5,119,947 | A | | 6/1992 | Stewart |
| 5,249,590 | A | | 10/1993 | Jacobus et al. |
| 5,351,837 | A | * | 10/1994 | Smith ..... 211/41.8 |
| 5,405,018 | A | | 4/1995 | Anthrop, Jr. |
| 5,580,025 | A | | 12/1996 | Cross |
| 5,601,195 | A | * | 2/1997 | Finola et al. ..... 211/41.8 |
| 5,918,749 | A | | 7/1999 | Pille et al. |
| 6,123,204 | A | | 9/2000 | Nelson et al. |
| 6,325,220 | B1 | | 12/2001 | Malmstrom |
| 6,364,131 | B1 | | 4/2002 | Moylan |
| 6,394,285 | B1 | | 5/2002 | Arthurs et al. |
| 6,557,567 | B2 | | 5/2003 | Mood |
| D488,594 | S | | 4/2004 | Miilu et al. |
| 6,827,225 | B2 | | 12/2004 | Miilu et al. |
| 6,848,585 | B2 | * | 2/2005 | VanLandingham ..... 211/41.9 |
| D518,615 | S | * | 4/2006 | Yang et al. ..... D32/55 |
| 2004/0079713 | A1 | | 4/2004 | Wendt et al. |

OTHER PUBLICATIONS

Kitchen Aid Clip, 3 pages, undated.

* cited by examiner

*Primary Examiner*—José V Chen
(74) *Attorney, Agent, or Firm*—Pearne & Gordon LLP

(57) ABSTRACT

Article retainers are provided for retaining an article with respect to a dishwasher rack. The article retainer comprises a fastening structure adapted to attach the article retainer to a dishwasher rack and an engagement member adapted to engage an article to position the article with respect to the dishwasher rack.

16 Claims, 8 Drawing Sheets

ARTICLE RETAINERS FOR A DISHWASHER RACK

FIELD OF THE INVENTION

The present invention relates to article retainers and more particularly to article retainers for a dishwasher rack.

BACKGROUND OF THE INVENTION

Conventional dishwashers typically include dishwasher racks adapted to support articles during a dishwashing cycle. For example, conventional racks may support pots, pans, plates, bowls, utensils, glassware, drinking vessels (e.g., cups, mugs, glasses, stemware) or other kitchenware. Dishwashers typically use pressurized water streams to wash the articles during the dishwashing cycle. While the pressurized water streams are effective to remove debris and other contaminents from the articles supported by the rack, the pressurized water streams may tend to shift articles loaded with respect to the rack. In some cases, articles may be shifted to a less effective article cleaning position. For example, a pressurized water stream may flip an inverted cup such that the cup collects water and debris and/or prevents the cup from drip drying on the rack after the dishwashing cycle.

It is known to provide an article retainer adapted to retain articles with respect to the dishwasher rack of a dishwashing machine. In use, such article retainers may help retain the articles with respect to the dishwasher rack when operating the dishwasher. Conventional article retainers typically include a fastening arrangement configured to attach the article retainer with respect to the dishwasher rack. However, conventional article retainers may shift from the desired orientation with respect to the rack and/or may be unintentionally removed from the rack. There is a continuing need for article retainers that can be effectively mounted to a dishwasher rack for subsequent use as an article holder.

SUMMARY OF THE INVENTION

Accordingly, it is an aspect of the present invention to obviate problems and shortcomings of conventional article retainers.

In accordance with one aspect, an article retainer is provided for retaining an article with respect to a dishwasher rack having a vertical tine attached to a horizontal wire. The article retainer comprises an engagement member adapted to engage an article to position an article with respect to a dishwasher rack. The article retainer further comprises a fastening structure with a fastening channel extending in a first direction. The fastening channel is open in a fastening direction extending substantially perpendicular to the first direction. The fastening structure is adapted to be moved in the fastening direction such that the fastening channel laterally receives a vertical tine and attaches the article retainer with respect to a vertical tine of a dishwasher rack. The article retainer further comprises a seat adapted to engage a horizontal wire of a dishwasher rack. The seat extends along the fastening direction and is open in the first direction. The article retainer may be moved in the first direction to engage the seat with a horizontal wire of a dishwasher rack. The seat is provided with a rotational stop adapted to inhibit rotation of the article retainer about a vertical tine of a dishwasher rack.

In accordance with another aspect, an article retainer is provided for retaining an article with respect to a dishwasher rack. The article retainer comprises a fastening structure adapted to attach the article retainer to a dishwasher rack and an engagement member adapted to engage an article to position an article with respect to a dishwasher rack. The engagement member comprises a first end portion attached to the fastening structure and a second end portion opposed from the first end portion. The article retainer further comprises a vertical stop comprising a protrusion extending from the engagement member.

In accordance with still another aspect, an article retainer is provided for retaining an article with respect to a dishwasher rack having a vertical tine attached to a horizontal wire. The article retainer comprises a fastening structure with a fastening channel extending in a first direction. The fastening channel includes a snapping structure and is open in a fastening direction extending substantially perpendicular to the first direction. The fastening structure is adapted to attach the article retainer with respect to a vertical tine of a dishwasher rack by moving the fastening structure in the fastening direction such that the fastening channel laterally and snappingly receives a vertical tine of a dishwasher rack. The article retainer further comprises a seat adapted to engage a horizontal wire of a dishwasher rack. The seat extends along the fastening direction and is open in the first direction. The article retainer may be moved in the first direction to engage the seat with a horizontal wire of a dishwasher rack. The seat is provided with a rotational stop adapted to inhibit rotation of the article retainer about a vertical tine of a dishwasher rack. The rotational stop comprises a protrusion that is elongated in the fastening direction and extends away from the seat in the first direction. The article retainer further includes an S-shaped engagement member adapted to engage an article to position an article with respect to a dishwasher rack. The S-shaped engagement member comprises a first end portion attached to the fastening structure and a second end portion opposed from the first end portion.

BRIEF DESCRIPTION OF THE DRAWINGS

The foregoing and other aspects of the present invention will become apparent to those skilled in the art to which the present invention relates upon reading the following description with reference to the accompanying drawings, in which.

DETAILED DESCRIPTION OF EXAMPLE EMBODIMENTS

Figure 1:
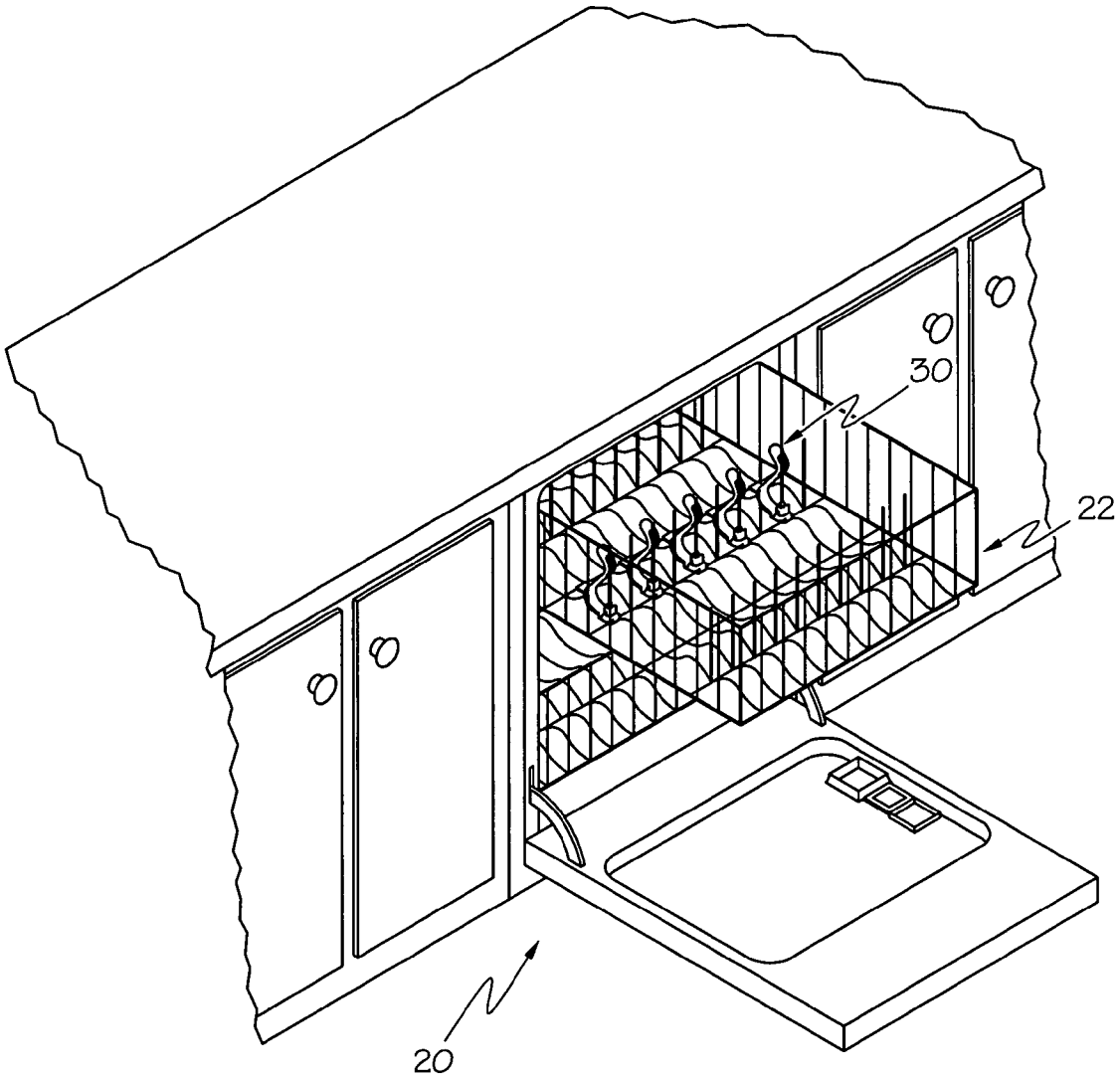
FIG. 1 is a perspective view of a dishwashing machine including a dishwasher rack provided with article retainers in accordance with an exemplary embodiments of the present invention.

Certain terminology is used herein for convenience only and is not to be taken as a limitation on the present invention. Further, in the drawings, the same reference numerals are employed for designating the same elements.

FIG. 1 depicts a perspective view of a dishwashing machine 20 including a dishwasher rack 22 provided with one or more article retainers 30 in accordance with exemplary embodiments of the present invention. Article retainers of the present invention may be used to retain various articles 21 with respect to the dishwasher rack 22. For example, article retainers of the present invention may be used to retain articles such as pots, pans, plates, bowls, utensils, glassware, drinking vessels (e.g., cups, mugs, glasses, stemware) or other kitchenware, or the like.

Figure 2:
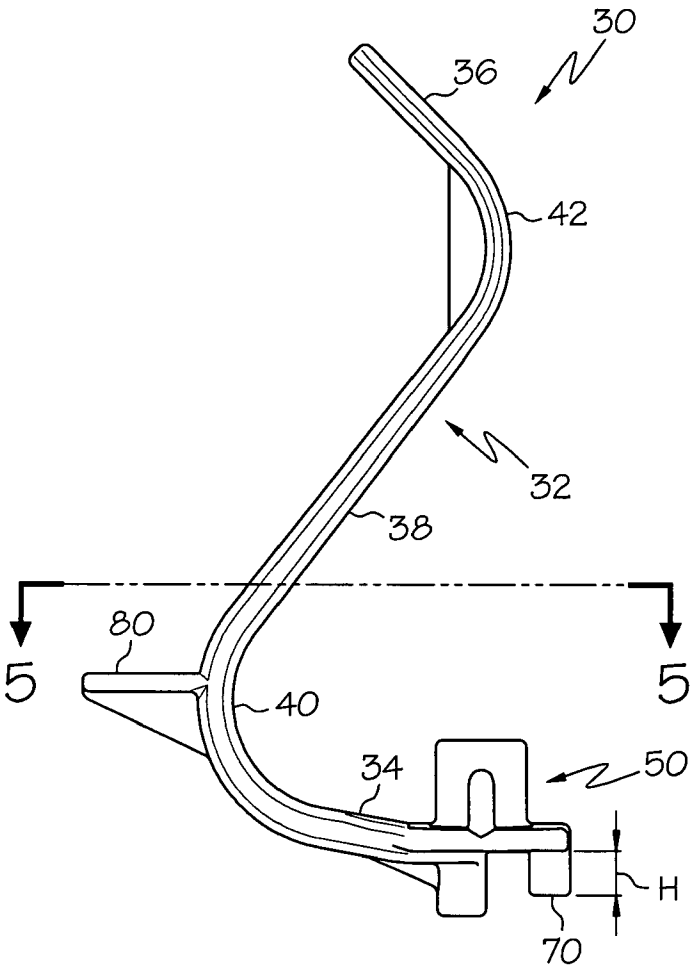
FIG. 2 is a side elevational view of an exemplary article retainer illustrated in FIG. 1.

FIG. 2 is a side elevational view of the exemplary article retainer 30 illustrated in FIG. 1. The article retainer 30 includes an engagement member 32 adapted to engage the article 21 to position the article with respect to the dishwasher rack 22 of the dishwashing machine 20. The engagement member 32 can include a first end portion 34 attached to a fastening structure 50 and a second end portion 36 opposed from the first end portion 34. The engagement member 32 can be constructed of a resilient material and/or can comprise a cross sectional shape adapted to permit flexing of the engagement member. For example, the engagement member can comprise an elongated tongue capable of being flexed away from a vertical tine to bias against an article being retained with respect to the dishwasher rack.

Figure 7:
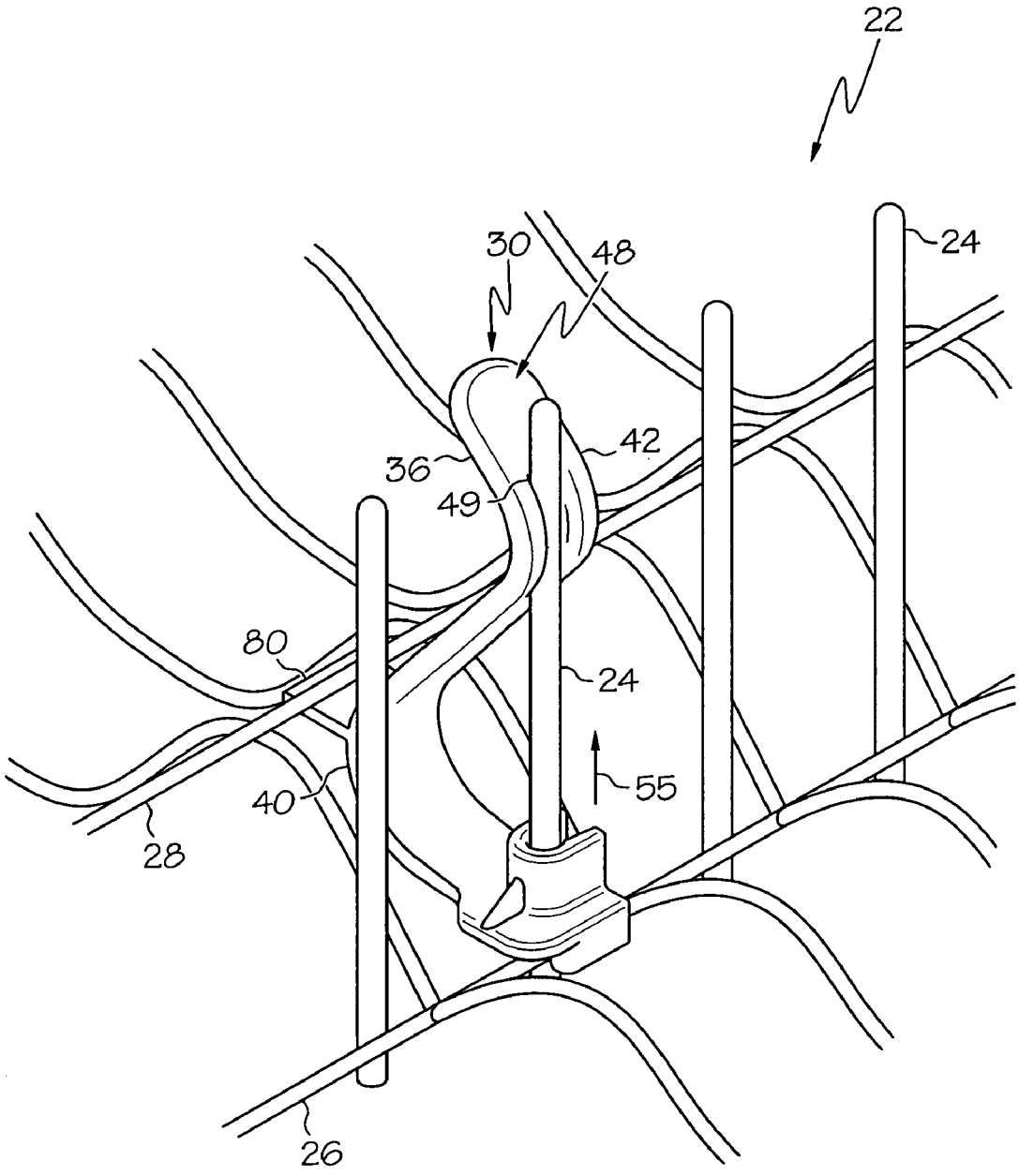
FIG. 7 is a rear perspective view of the article retainer of FIG. 2 mounted to a dishwasher rack.
Figure 8:
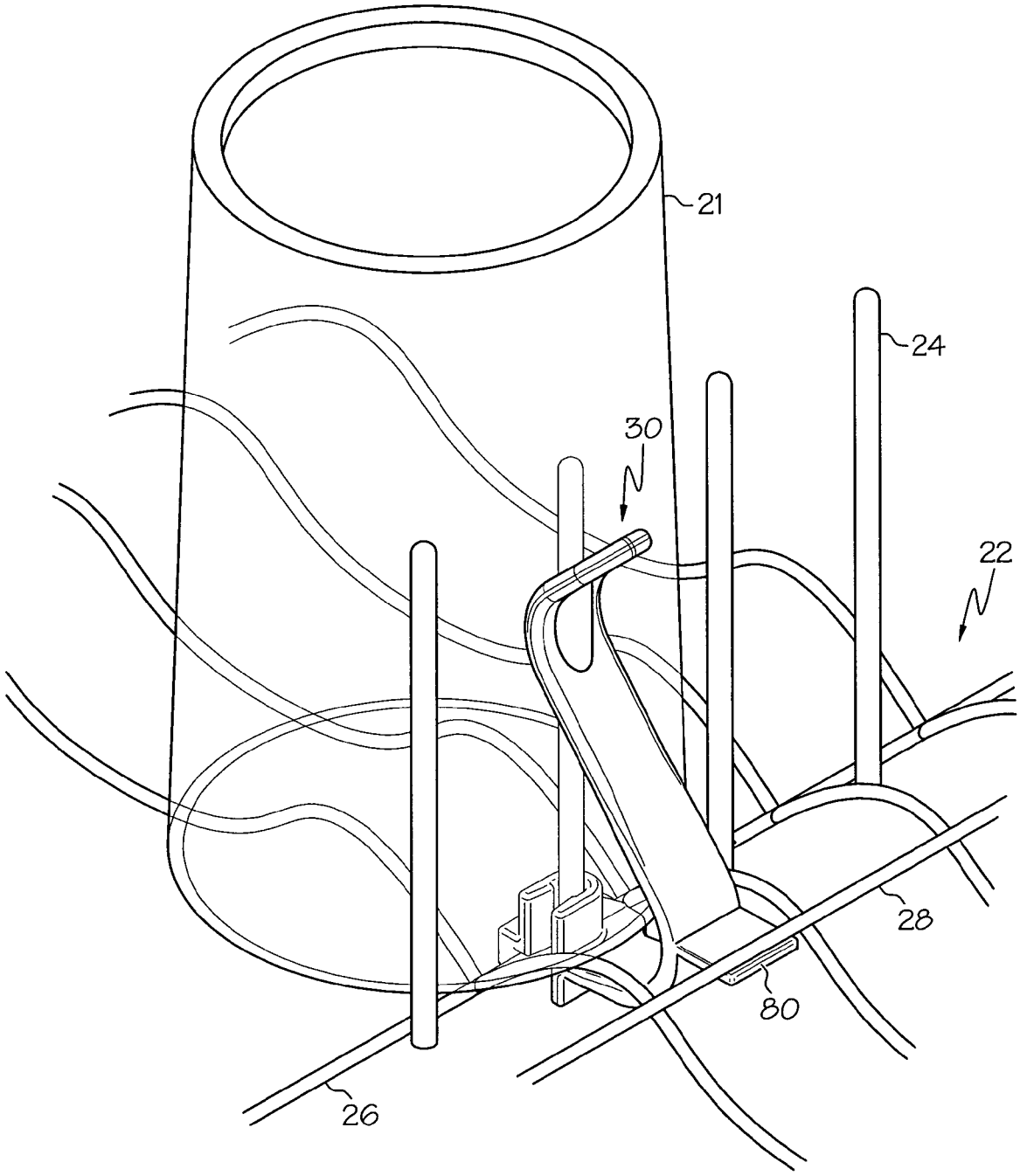
FIG. 8 is a front perspective view of the article retainer of FIG. 2 mounted to a dishwasher rack and retaining an article with respect to the dishwasher rack.

The engagement member can also comprise a wide variety of shapes to perform the retaining function. For example, exemplary engagement members may comprise a crescent shape, an L-shape, or other shape sufficient to retain an article with respect to a dishwasher rack. The illustrated engagement member comprises an S-shaped engagement member as best illustrated in FIG. 2. The S-shaped engagement member 32 comprises a first bend 40 and a second bend 42 connecting an intermediate portion 38 between the first end portion 34 and the second end portion 36. As shown in FIG. 7, the S-shaped configuration of the engagement member can provide an article reception area 48. The article reception area 48 is formed by an upper portion of a vertical tine 24 and the second end portion 36 of the engagement member 32. As further illustrated, the second end portion 36 may be angled with respect to the vertical tine 24. Such angled positioning facilitates guidance of the article being retained to an engagement area 49 between the engagement member 32 and the vertical tine 24 wherein further downward movement of the article causes movement of the second end portion 36 away from the vertical tine 24 while the second bend 42 is biased against the article.

Figure 4:
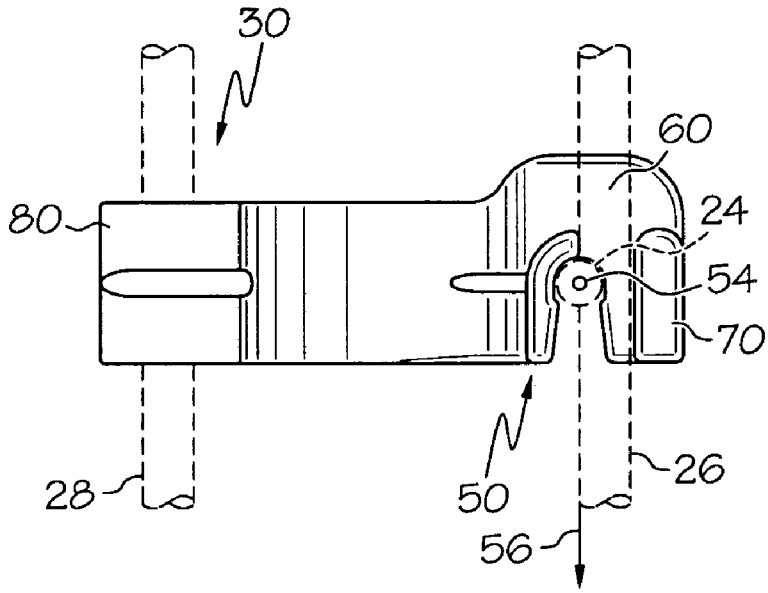
FIG. 4 is a bottom view of the article retainer of FIG. 2.
Figure 5:
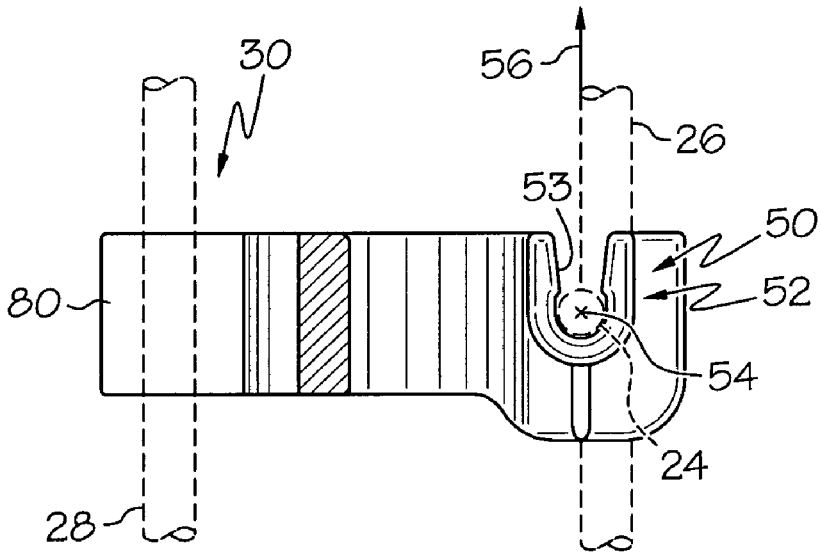
FIG. 5 is as sectional view of the article retainer along line 5-5 of FIG. 2.
Figure 6:
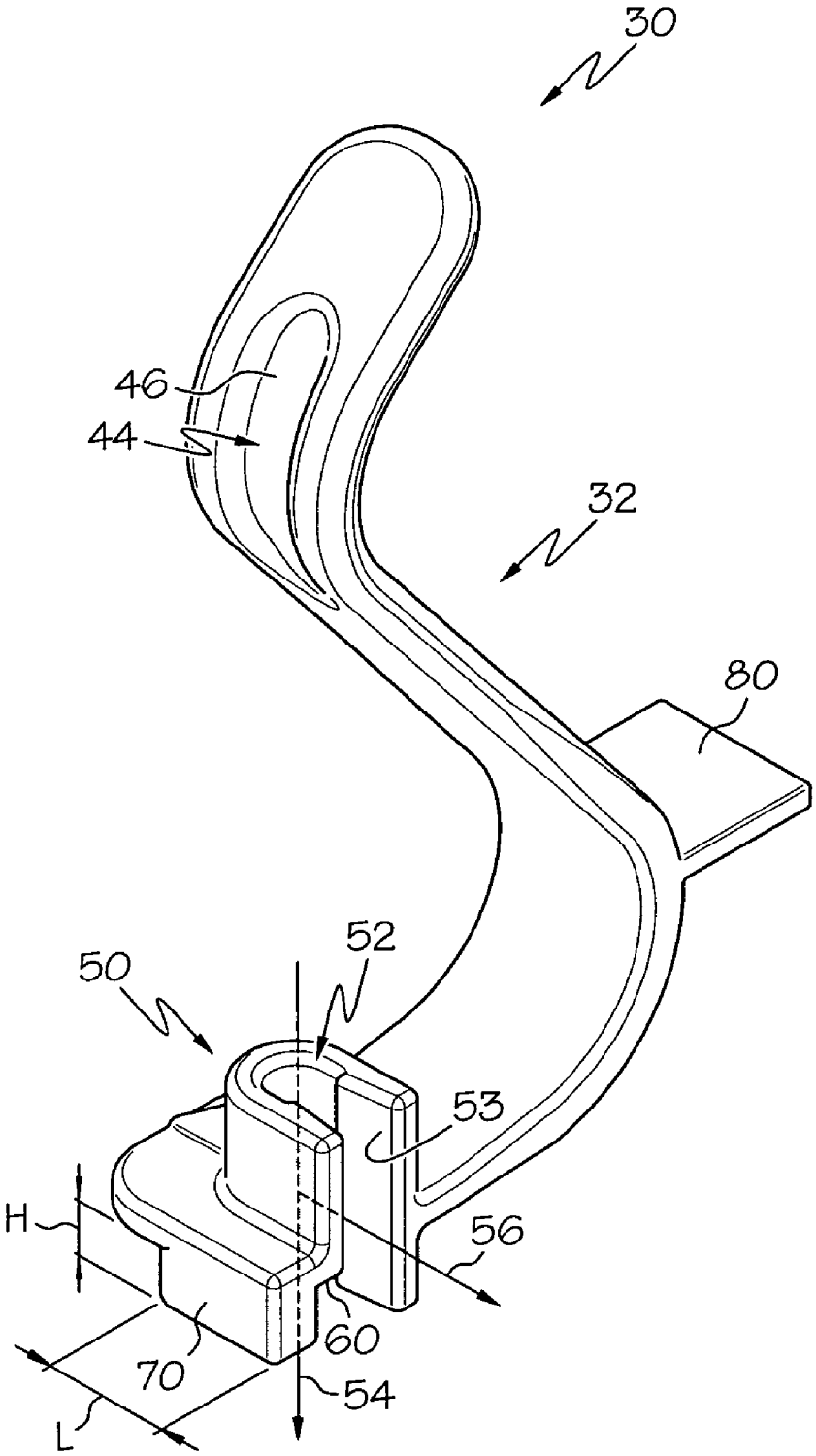
FIG. 6 is a perspective view of the article retainer of FIG. 2.

Article retainers of the present invention further include a fastening structure adapted to attach the article retainer to the dishwasher rack. The fastening structures may be designed to attach to various locations of the dishwasher rack such as a horizontal wire, vertical tine, or other location of the dishwasher rack. For example, the fastening structure 50 of the illustrated article retainer 30 is adapted to attach the article retainer to the vertical tine 24 of the dishwasher rack 22. As shown in FIGS. 4-6, the fastening structure 50 can include a fastening channel 52 extending in a first direction 54 wherein the fastening channel 52 is open in a fastening direction 56 extending substantially perpendicular to the first direction 54. The fastening structure 50 is adapted to be moved in the fastening direction 56 such that the fastening channel 52 laterally receives the vertical tine 24 and attaches the article retainer 30 with respect to the vertical tine 24 of the dishwasher rack 22.

The fastening channel 52 may include a variety of shapes adapted to facilitate attachment of the article retainer to the vertical tine. For example, the fastening channel 52 can include a shape corresponding to the shape of the vertical tine to allow firm attachment to the vertical tine. For instance, as shown in FIGS. 4 and 5, the fastening channel 52 includes a semicircular interior surface that has a diameter substantially equal to the diameter of the vertical tine 24. The semicircular interior surface may comprise a smooth surface such that the entire semicircular surface engages an outer surface of the vertical tine. In further embodiments, the semicircular surface may comprise a knurled or cleated surface adapted to facilitate gripping of the vertical tine. Still further, the fastening channel 52 may comprise further structures adapted to secure the vertical tine within the channel and/or provide an indication that the vertical tine is adequately seated within the fastening channel. For example, as shown in FIGS. 4-6, the fastening channel 52 can include a snapping structure 53 wherein the fastening channel 52 is adapted to snappingly receive the vertical tine 24 of the dishwasher rack 22. The snapping structure 53 may comprise one or more ramped surfaces adapted to encourage reception of the vertical tine by the fastening channel while discouraging removal of a seated vertical tine from the fastening channel. As shown, the fastening structure 53 comprises a pair of opposed ramped surfaces that end in an enlarged tine-reception area. When snapping the vertical tine in place, the fastening structure 50 is adapted to be moved in the fastening direction 56 such that the fastening channel 52 laterally receives the vertical tine 24 and attaches the article retainer 30 with respect to the vertical tine 24 of the dishwasher rack 22. Once sufficiently inserted, the vertical tine snaps in the enlarged tine-reception area which provides an indication that the tine is sufficiently seated within the fastening channel. The snapping connection also secures the vertical tine within the channel and inhibits inadvertent removal of the vertical tine from the fastening channel.

The article retainer 30 can further include a seat 60 adapted to engage a horizontal wire 26 of the dishwasher rack 22. The seat 60 can comprise a wide variety of structures sufficient to engage a horizontal wire 26 to facilitate relative vertical positioning of the article retainer 30 with respect to the dishwasher rack 22. As shown in FIG. 4, the seat 60 comprises a surface area that is open in the first direction 54 such that the article retainer may be moved in the first direction 54 to engage the seat 60 with the horizontal wire 26 of the dishwasher rack 22. The seat 60 can also extend along the fastening direction 56 such to resist tilting of the article retainer 30 with respect to the vertical tine 24.

As apparent in FIGS. 4-8, the article retainer 30 can be moved in the first direction 54 to engage the seat 60 with the horizontal wire 26 of the dishwasher rack 22. The seat 60 can facilitate positioning of the article retailer 30 with respect to the horizontal wire 26. For example, when attaching the article retainer to the dishwasher rack, the article retainer 30 can be positioned between a pair of the vertical tines 24 of the dishwasher rack 22. Next, the article retainer 30 can be moved in the first direction 54 such that the seat 60 engages the horizontal wire 26 to vertically position the article retainer 30 with respect to the dishwasher rack 22. With the seat 60 engaging the horizontal wire 26, the article retainer 30 may be moved in the fastening direction 56 such that the fastening channel 52 laterally receives a selected one of the vertical tines 24 of the dishwasher rack 22.

In another example of attaching the article retainer, the article retainer may be positioned between a pair of vertical tines 24 of the dishwasher rack 22. Next, the article retainer may be moved in the fastening direction 56 such that the fastening channel 52 laterally receives a selected one of the vertical tines 24 of the dishwasher rack 22. Next, the article retainer 30 can moved in the first direction 54 to engage the seat 60 with the horizontal wire 26 to vertically position the article retainer 30 with respect to the dishwasher rack 22.

In still further embodiments of the present invention, the article retainer 30 may be provided with a rotational stop adapted to inhibit rotation of the article retainer 30 about the vertical tine 24 of the dishwasher rack 22. The rotational stop, if provided, can assist in radially orienting the article retainer 30 an appropriate position relative to the vertical tine 24. In exemplary embodiments, the rotational stop can include a member adapted to interact with the horizontal wire 26 to inhibit rotation of the article retainer 30 about the vertical tine 24. For example, as shown in FIG. 6, the rotational stop can comprise a protrusion 70 extending away from the seat 60 in the first direction 54 such that the protrusion 70 has a height "H" relative to the seat 60. In addition or alternatively, the rotational stop can comprise a protrusion that is elongated in the fastening direction 56. For example, as shown in FIG. 6, the protrusion 70 is elongated with a length "L" in the fastening direction 56. Providing an elongated protrusion may increase the area of contact between the protrusion and the horizontal member to radially position the article retainer 30 with respect to the vertical tine 24 in a preselected radial position.

As mentioned previously, the seat 60 can extend along the fastening direction 56 to resist tilting of the article retainer 30 with respect to the vertical tine 24. In addition, or alternatively, the engagement member 32 may be adapted to engage the vertical tine 24 to resist tilting of the article retainer 30 with respect to the vertical tine 24. For example, as shown in FIG. 6, the engagement member 32 may comprise a recessed surface 44 defining a channel 46. As shown in FIG. 7, the channel 46 is adapted to receive a portion of a vertical tine to inhibit tilting of the article retainer 30 with respect to the vertical tine 24 when the article retainer 30 is in a nonuse position. The recessed surface 44, if provided, can comprise a wide variety of surface characteristics. In the illustrated example, the recessed surface 44 comprises a concave surface. Providing a concave surface can inhibit crimping of delicate articles being retained by the article retainer 30.

The channel 46, if provided, can also be provided at any location along the engagement member. As shown, the channel 46 can be offset from the seat 60 to increase the distance therebetween. Increasing the distance between the channel 46 and a seat 60 can further reduce the tendency of external forces from tilting the article retainer 30 with respect to the vertical tine 24. As further shown, the channel 46 may be provided at the second bend 42 of an S-shaped engagement member.

Exemplary article retainers discussed throughout this application may further include an optional vertical stop adapted to inhibit disengagement of the seat 60 from the horizontal wire 26 by limiting movement of the article retainer 30 in a second direction 55 opposite from the first direction 54. Such a vertical stop can facilitate maintenance of the article retainer 30 within an appropriate relative position with respect to the dishwasher rack 22. The vertical stop can also facilitate proper orientation of the rotational stop such that the rotational stop is continuously effective to inhibit rotational movement of the article retainer 30 about the vertical tine 24. The vertical stop, if provided, can comprise various alternative structures adapted to interact with one or more portions of the dishwasher rack. In the illustrated example, the vertical stop comprises a protrusion 80 extending from the engagement member 32. As shown, the protrusion 80 can extend below a second horizontal wire 28 of the dishwasher rack 22 to act as a vertical stop. Providing the engagement member 32 as an S-shaped member can facilitate appropriate placement of the protrusion 80 underneath the second horizontal wire 28. For example, as shown, the protrusion 80 can extend from the first bend 40 such the protrusion 80 extends below the second horizontal wire 28 that is offset from the first horizontal wire 26.

Figure 3B:
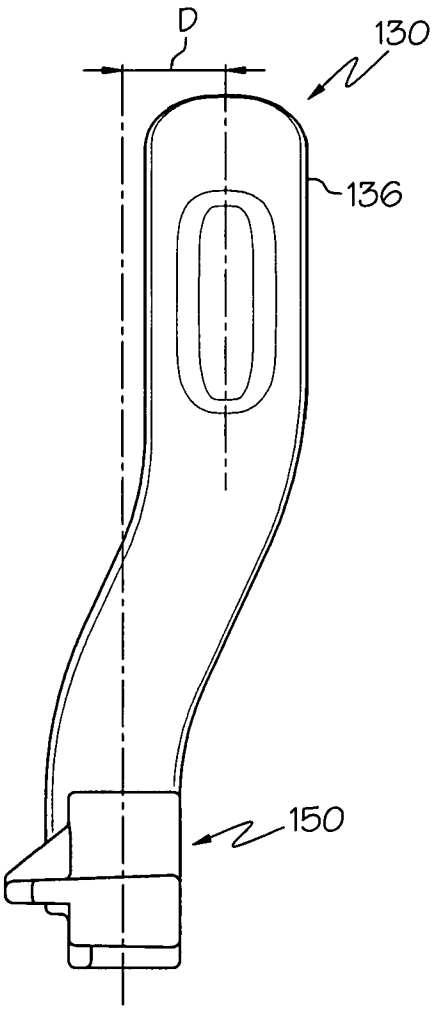
FIG. 3B is a front elevational view of an article retainer in accordance with further exemplary embodiments of the present invention.
Figure 3A:
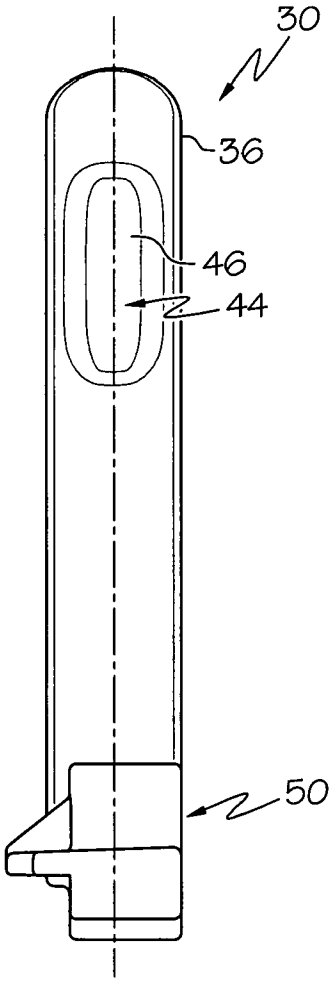
FIG. 3A is a front elevational view of the article retainer of FIG. 2.
Figure 9:
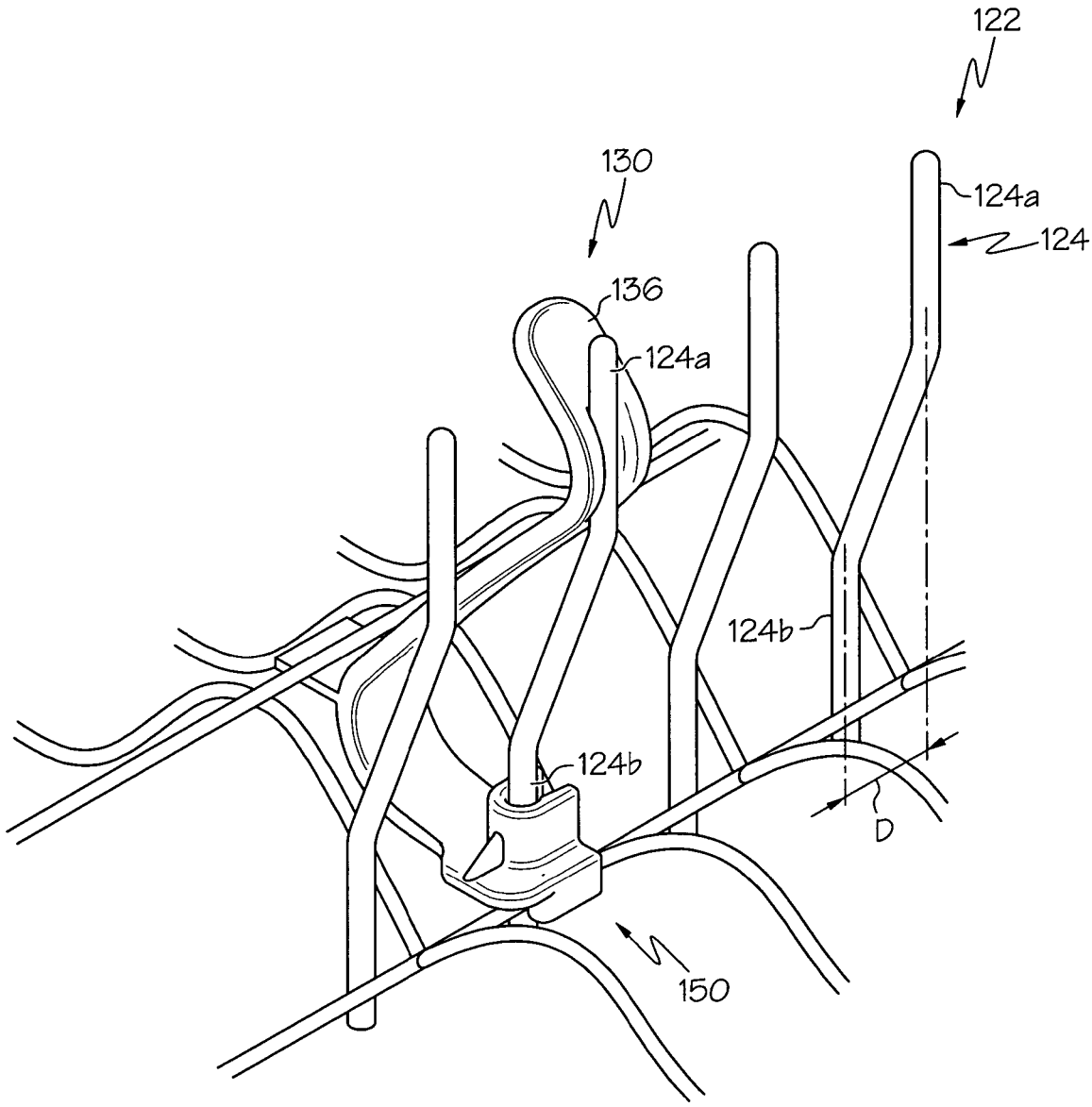
FIG. 9 is a rear perspective view of the article retainer of FIG. 3B mounted to a dishwasher rack.
Figure 10:
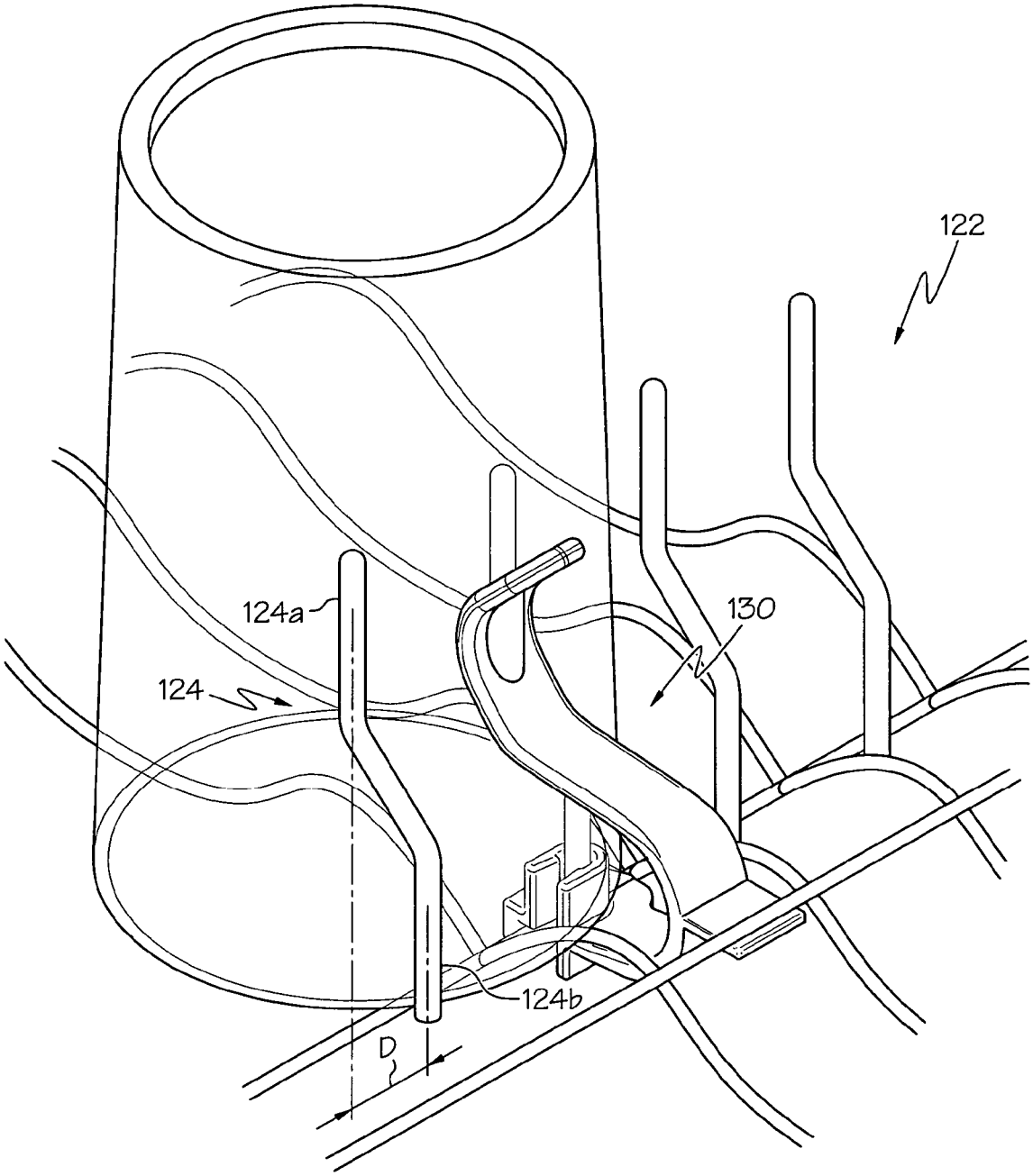
FIG. 10 is a front perspective view of the article retainer of FIG. 3B mounted to a dishwasher rack and retaining an article with respect to the dishwasher rack.

Article retainers herein may be provided a various shapes and sizes to accommodate particular articles or a wide range of articles relative to dishwasher baskets of various sizes and shapes. For example, as shown in FIG. 3A, the illustrated article retainer 30 includes a second end portion 36 that is laterally aligned with the fastening structure 50. Such article retainers are useful for substantially straight vertical tines (e.g., see FIGS. 7 and 8). It will be appreciated that the article retainers may be adapted to retain articles with dishwasher baskets having alternative vertical tine configurations. For example, as shown in FIGS. 9 and 10, certain dishwasher racks 122 include offset vertical tines 124 that have an upper portion 124*a* that is laterally offset from a lower portion 124*b* by a distance "D". FIG. 3B depicts an exemplary article retainer 130 to accommodate the offset vertical tine 124. The exemplary article retainer 130 can be identical to the article retainer 30 discussed above accept for a laterally offset second end portion 136. Indeed, the article retainer 130 includes a second end portion 136 that is laterally offset from the fastening structure 150 by a distance "D". As shown in FIG. 9, the fastening structure 150 may be attached to the lower portion 124*b* of the vertical tine 124 while the laterally offset second end portion 136 may be positioned with respect to the laterally offset upper portion 124*a* of the vertical tine 124. In further examples, article retainers may accommodate vertical tines with upper and lower portions offset in directions other than laterally, such as in a direction in front or behind the horizontal wire to which lower portion of the vertical tine is attached.

Article retainers in accordance with the present invention may be fabricated with a wide range of materials that can perform a retaining function and withstand environmental conditions during the dishwashing cycle. For example, article retainers may be fabricated from polymeric materials. For instance, article retainers may be fabricated from Celcon® M90 acetal copolymer available from Ticona having a place of business in Florence, Ky. It will be appreciated that article retainers may be fabricated from other materials while incorporating aspects of the present invention. Moreover, article retainers herein may be formed by injection molding or other techniques. Still further, article retainers herein may be formed from separate elements that are connected together or may be integrally formed as a single unit. For instance, the engagement member may be integral with the fastening structure to reduce manufacturing costs.

From the above description of the invention, those skilled in the art will perceive improvements, changes and modifications. Such improvements, changes and modifications within the skill of the art are intended to be covered by the appended claims.

What is claimed:

1. An article retainer for retaining an article with respect to a dishwasher rack having a vertical tine attached to a horizontal wire, the article retainer comprising:

an engagement member adapted to engage an article to position an article with respect to a dishwasher rack;

a fastening structure with a fastening channel extending in a first direction, wherein the fastening channel is open in a fastening direction extending substantially perpendicular to the first direction, wherein the fastening structure is adapted to be moved in the fastening direction such that the fastening channel laterally receives a vertical tine and attaches the article retainer with respect to a vertical tine of a dishwasher rack;

a seat adapted to engage a horizontal wire of a dishwasher rack, the seat extending along the fastening direction and open in the first direction wherein the article retainer may be moved in the first direction to engage the seat with a horizontal wire of a dishwasher rack, and wherein the seat is provided with a rotational stop adapted to inhibit rotation of the article retainer about a vertical tine of a dishwasher rack; and a vertical stop comprising a protrusion extending from the engagement member such that the protrusion is adapted to engage a horizontal wire of a dishwasher rack that is adjacent to a horizontal wire to which the seat is to be attached to inhibit disengagement of the seat from a horizontal wire by limiting movement of the article retainer in a second direction opposite the first direction.

2. The article retainer of claim 1, wherein the engagement member comprises a first end portion attached to the fastening structure and a second end portion opposed from the first end portion.

3. The article retainer of claim 2, wherein the engagement member is S-shaped.

4. The article retainer of claim 1, wherein the rotational stop comprises a protrusion extending away from the seat in the first direction.

5. The article retainer of claim 1, wherein the rotational stop comprises a protrusion that is elongated in the fastening direction.

6. The article retainer of claim 5, wherein the protrusion extends away from the seat in the first direction.

7. The article retainer of claim 1, wherein the fastening channel includes a snapping structure, wherein the fastening channel is adapted to snappingly receive a vertical tine of a dishwasher rack.

8. An article retainer for retaining an article with respect to a dishwasher rack, the article retainer comprising:

a fastening structure adapted to attach the article retainer to a dishwasher rack;

an engagement member adapted to engage an article to position an article with respect to a dishwasher rack, the engagement member comprising a first end portion attached to the fastening structure and a second end portion opposed from the first end portion; and a vertical stop comprising a protrusion extending from the engagement member such that the protrusion engages a horizontal wire of a dishwasher rack when said article retainer is attached to the dishwasher rack by said fastening structure.

9. The article retainer of claim 8, wherein the engagement member includes a recessed surface defining a channel adapted to receive a portion of a vertical tine of a dishwasher rack.

10. The article retainer of claim 8, wherein the second end portion of the engagement member is laterally offset from the fastening structure.

11. The article retainer of claim 8, wherein the second end portion of the engagement member is laterally aligned with the fastening structure.

12. The article retainer of claim 8, wherein the engagement member is integral with the fastening structure.

13. The article retainer of claim 8, wherein the engagement member is S-shaped.

14. An article retainer for retaining an article with respect to a dishwasher rack having a vertical tine attached to a horizontal wire, the article retainer comprising:

a fastening structure with a fastening channel extending in a first direction, wherein the fastening channel includes a snapping structure and is open in a fastening direction extending substantially perpendicular to the first direction, wherein the fastening structure is adapted to attach the article retainer with respect to a vertical tine of a dishwasher rack by moving the fastening structure in the fastening direction such that the fastening channel laterally and snappingly receives a vertical tine of a dishwasher rack;

a seat adapted to engage a horizontal wire of a dishwasher rack, the seat extending along the fastening direction and open in the first direction wherein the article retainer may be moved in the first direction to engage the seat with a horizontal wire of a dishwasher rack, and wherein the seat is provided with a rotational stop adapted to inhibit rotation of the article retainer about a vertical tine of a dishwasher rack, the rotational stop comprising a protrusion that is elongated in the fastening direction and extends away from the seat in the first direction;

an S-shaped engagement member adapted to engage an article to position an article with respect to a dishwasher rack, the S-shaped engagement member comprising a first end portion attached to the fastening structure and a second end portion opposed from the first end portion; and a vertical stop adapted to engage a horizontal wire of a dishwasher rack to inhibit disengagement of the seat from a horizontal wire by limiting movement of the article retainer in a second direction opposite the first direction.

15. The article retainer of claim 14, wherein the vertical stop comprises a protrusion extending from the S-shaped engagement member such that the protrusion is adapted to engage a horizontal wire of a dishwasher rack.

16. The article retainer of claim 14, wherein the S-shaped engagement member includes a recessed surface defining a channel adapted to receive a portion of a vertical tine of a dishwasher rack.

* * * * *